United States Patent [19]

Nakagawa et al.

[11] Patent Number: 5,065,716

[45] Date of Patent: Nov. 19, 1991

[54] FUEL SUPPLY CONTROL SYSTEM FOR INTERNAL COMBUSTION ENGINE WITH IMPROVED ENGINE ACCELERATION CHARACTERISITCS AFTER FUEL CUT-OFF OPERATION

[75] Inventors: Toyoaki Nakagawa; Hatsuo Nagaishi, both of Kanagawa, Japan

[73] Assignee: Nissan Motor Company, Limited, Kanagawa, Japan

[21] Appl. No.: 327,550

[22] Filed: Mar. 23, 1989

[30] Foreign Application Priority Data

Mar. 25, 1988 [JP] Japan ..... 63-39838[U]

[51] Int. Cl.[5] ..... F02D 41/10; F02D 41/12

[52] U.S. Cl. ..... 123/326; 123/492; 123/493

[58] Field of Search ..... 123/326, 325, 333, 492, 123/493

[56] References Cited

U.S. PATENT DOCUMENTS

| | | | |
|---|---|---|---|
| 4,327,682 | 5/1982 | Harada | 123/326 |
| 4,452,212 | 6/1984 | Takase | 123/326 |
| 4,655,179 | 4/1987 | Kashiwagura | 123/326 |
| 4,694,807 | 9/1987 | Mori | 123/493 |
| 4,896,644 | 1/1990 | Kato | 123/492 |

FOREIGN PATENT DOCUMENTS

| | | |
|---|---|---|
| 3802710 | 9/1988 | Fed. Rep. of Germany . |
| 57-124033 | 8/1982 | Japan . |
| 58-178837 | 10/1983 | Japan . |
| 61-43230 | 3/1986 | Japan . |
| 61-96158 | 5/1986 | Japan . |

*Primary Examiner*—Andrew M. Dolinar

*Attorney, Agent, or Firm*—Lowe, Price, LeBlanc & Becker

[57] ABSTRACT

A fuel supply control system performs asynchronous fuel injection in response to acceleration demand for injecting a controlled amount of fuel irrespective of an engine revolution cycle. The amount of fuel for asynchronous injection in an engine transition state from engine decelerating state, in which fuel cut-off is performed, to engine acceleration state, is determined on the basis of a set value which is a latched fuel injection upon initiation of fuel cut-off operation, and an instantaneous fuel injection amount derived on the basis of the instantaneous fuel injection control parameters. The set value is modified in relation to an amount of fuel left on a periphery of an induction system.

5 Claims, 5 Drawing Sheets

FUEL SUPPLY CONTROL SYSTEM FOR INTERNAL COMBUSTION ENGINE WITH IMPROVED ENGINE ACCELERATION CHARACTERISITCS AFTER FUEL CUT-OFF OPERATION

BACKGROUND OF THE INVENTION

1. Field of the Invention

The present invention relates generally to a fuel supply control system for an internal combustion engine, such as an automotive internal combustion engine. More specifically, the invention relates to a fuel supply control system which can achieve improved transition characteristics in a transition from an engine deceleration state to an engine acceleration state.

2. Description of the Background Art

In the modern and advanced automotive technologies, it has been required substantially high level of precision in engine operation control in view of anti-polution, high performance and better fuel economy. One of the essential factors in achieving high precision level engine operation control controlling fuel supply amount with satisfactorily high precision. Particularly, in the recent years, it has been required to correct fuel supply amount for compensating fuel wetting an air induction passage and thus cannot be introduced into an engine combustion chamber at a desired timing.

The conventional fuel supply control system controls fuel supply amount typically based on an engine revolution speed and an intake air flow rate which is monitored by an air flow meter disposed in the air induction system upstream of a throttle valve. Such conventional fuel supply control system has been disclosed in Japanese Patent First (unexamined) Publication (Tokkai) Showa 59-538. The conventional fuel supply control system cannot achieve required level of precision because of distance between the air flow meter and a fuel injection valve. Namely, since the air flow meter is disposed at a position upstream of the throttle valve and the fuel injection valve is disposed at a position downstream of the throttle valve, the intake air flow rate at the position of the air induction passage where the fuel injection valve is disposed, is normally different from that at the position of the air flow meter. This particularly affects upon accelerating transition of the engine. Furthermore, fuel injection amount is derived irrespective of the fuel amount which wets the inner periphery of the air induction passage. Therefore, air/fuel ratio tends to become lean to cause degradation of the engine acceleration characteristics.

In order to improve this, Japanese Patent First Publication (Tokkai) Showa 60-162066 owned by the common owner to the present invention, proposes a fuel supply control system, in which intake air flow rate is derived by smoothing the output of the air flow meter with a primary lag factor and the fuel injection amount is derived on the basis of the smoothed intake air flow rate. Utilizing of the smoothed air flow rate data for deriving fuel injection amount encounters a defect in that the fuel injection amount becomes smaller than required amount at initial stage of acceleration transition to make the air/fuel ratio of the air/fuel mixture unacceptably leaner than that required. In addition, in the transition from the engine decelerating state where fuel cut-off is performed to the engine acceleration state in which fuel supply is resumed. In the fuel injection control disclosed in the aforementioned Japanese Patent First Publication Showa 63-162066, asynchronous injection irrespectively engine revolution cycle is performed for acceleration fuel enrichment at the initial stage of acceleration. Fuel injection amount for asynchronous injection is derived based on a fuel injection amount upon initiation of fuel cut-off operation and a fuel injection amount derived on the basis of instantaneous fuel injection control parameters including the smoothed air flow rate. During fuel cut-off state, fuel on the peripheral surface of the air induction passage is drawn into the engine combustion chamber to dry the periphery. Therefore, upon resumption of fuel injection, relatively large amount is required for wetting the periphery of the air induction passage.

In the aforementioned conventional fuel supply control system, fuel amount for asynchronous injection for acceleration enrichment simply based on the difference between the fuel injection amount upon fuel cut-off and upon fuel resumption. Therefore, certain amount of fuel injected in asynchronous injection is consumed for wetting the periphery of the air induction passage. This makes the amount of fuel actually forming air/fuel mixture to be introduced into the engine combustion chamber becomes insufficient for obtaining desired engine acceleration characteristics.

SUMMARY OF THE INVENTION

Therefore, it is an object of the present invention to provide a fuel supply control system which can achieve stability of fuel supply control without causing degradation of engine transition characteristics.

Another object of the invention is to provide a fuel supply control system which can derive a fuel supply amount for temporary or asynchronous injection for fuel resumption with an additional amount for wetting periphery of an induction passage.

In order to accomplish aforementioned and other objects, a fuel supply control system, according to the present invention, performs asynchronous fuel injection in response to acceleration demand for injecting a controlled amount of fuel irrespective of an engine revolution cycle. The amount of fuel for asynchronous injection in an engine transition state from engine decelerating state, in which fuel cut-off is performed, to engine acceleration state, is determined on the basis of a set value which is a latched fuel injection upon initiation of fuel cut-off operation, and an instantaneous fuel injection amount derived on the basis of the instantaneous fuel injection control parameters. The set value is modified in relation to an amount of fuel left on a periphery of an induction system.

According to one aspect of the invention, a fuel supply control system for an internal combustion engine, comprises:

an induction system for introducing a controlled flow rate of intake air and forming an air/fuel mixture to be introduced into an engine combustion chamber;

first sensor for monitoring intake air flow rate flowing through the induction system to produce an intake air flow rate indicative first signal;

second detector for monitoring a predetermined engine driving condition satisfying a fuel cut-off condition to produce a fuel cut-off condition indicative second signal;

first means for controlling fuel supply amount for supplying a controlled amount of fuel into the induction system at a controlled timing determined in relation to an engine revolution cycle, the first means being responsive to the second signal to perform fuel cut-off operation, and the first means being responsive to termination of the second signal, for temporarily performing fuel supply irrespective of engine revolution cycle; and second means for deriving a fuel supply amount for the temporary fuel supply in response to termination of fuel cut-off, the second means deriving the fuel supply amount for the temporary fuel supply with containing a component compensating a fuel amount required for wetting the periphery of the induction system.

According to another aspect of the invention, a fuel injection control system for an internal combustion engine, comprising:

an induction system for introducing a controlled flow rate of intake air and forming an air/fuel mixture to be introduced into an engine combustion chamber;

first sensor for monitoring intake air flow rate flowing through the induction system to produce an intake air flow rate indicative first signal;

second detector for monitoring a predetermined engine driving condition satisfying a fuel cut-off condition to produce a fuel cut-off condition indicative second signal;

first means for controlling fuel injection amount for supplying a controlled amount of fuel into the induction system at a controlled timing determined in relation to an engine revolution cycle, the first means being responsive to the second signal to perform fuel cut-off operation, and the first means being responsive to termination of the second signal, for temporarily performing fuel injection irrespective of engine revolution cycle; and second means for deriving a fuel injection amount for the temporary fuel injection in response to termination of fuel cut-off, the second means deriving the fuel injection amount for the temporary fuel injection with containing a component compensating a fuel amount required for wetting the periphery of the induction system.

The second means is responsive to initiation of the fuel cut-off operation for latching an instantaneous fuel injection amount upon initiation of fuel cut-off, and subtracting the latched value from an instantaneous fuel injection amount derived upon termination of fuel cut-off for deriving the fuel injection amount for temporary fuel injection, and the second means modifies the fuel injection amount by the compensating component for wetting the periphery of the induction system. The second means modifies to decrease the latched value according to elapsed time in performing fuel cut-off for including the compensating component in the fuel injection amount for temporary fuel injection.

The fuel injection control system further comprises a third sensor for monitoring an engine revolution to produce an engine speed indicative third signal, and the first means derives a basic fuel injection amount on the basis of the first signal and the third signal and modifies the basic fuel injection amount by introducing a primary lag factor.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
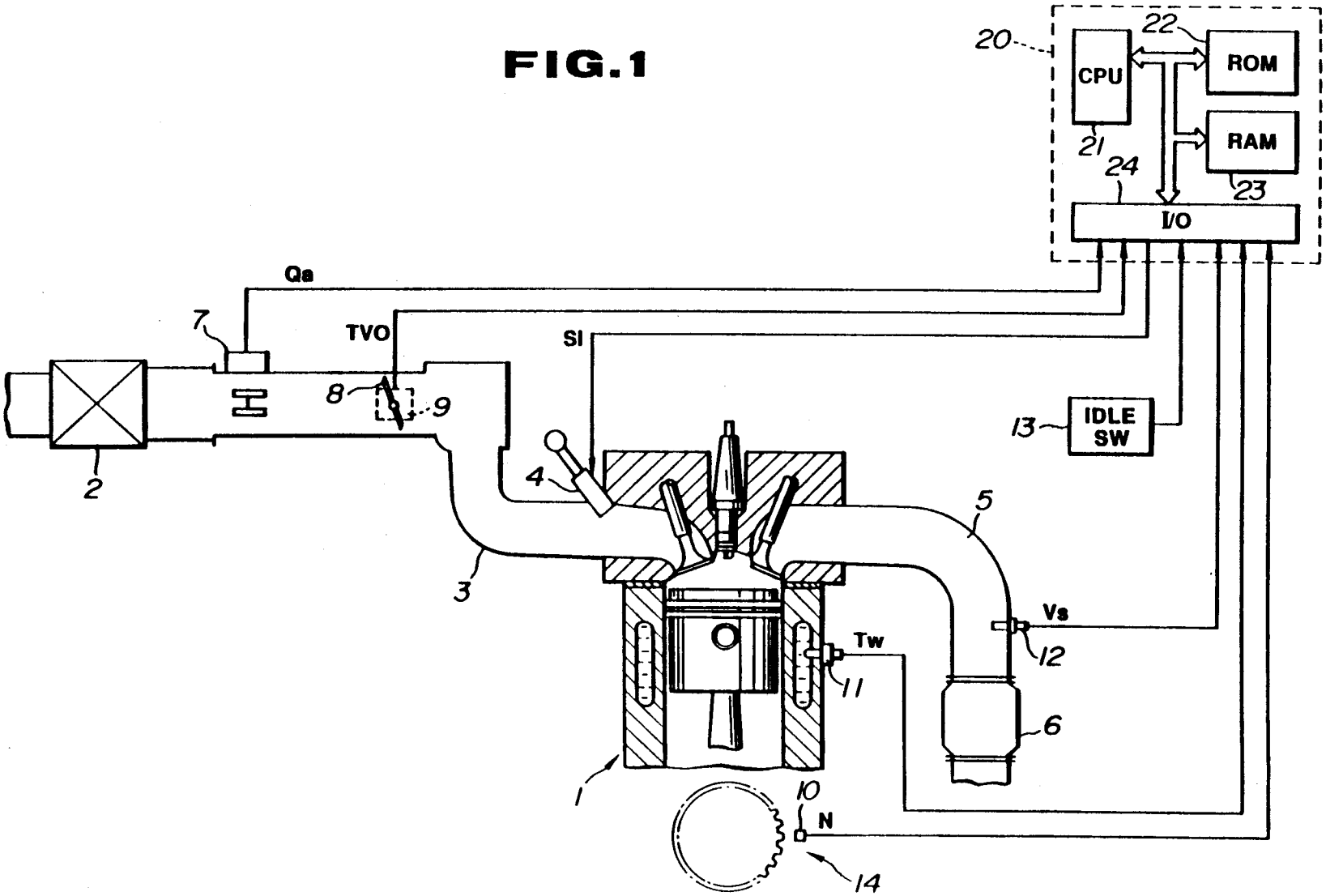
FIG. 1 is a block diagram of the preferred embodiment of a fuel supply control system according to the present invention.

Referring now to the drawings, particularly to FIG. 1, the preferred embodiment of a fuel supply control system, according to the present invention, is associated with an internal combustion engine 1 which has an air induction system 3 including an air cleaner 2 and a throttle valve 8, and an exhaust system 5 including a catalytic converter 6 for removing polutants, such as CO, HC, $NO_x$. One or more fuel injection valves 4 are disposed in branch passage of an intake manifold in the air induction system 3 for injecting controlled amount of fuel at controlled timings.

In order to control the fuel injection amount and fuel injection timing, a control unit 20 which comprises CPU 21, ROM 22, RAM 23 and an input/output (I/O) interface 24, is provided. The control unit 20 is connected to the fuel injection valves 4 for controlling valve open timing for controlling the fuel injection amount and the fuel injection timing. The control unit 20 is also connected to an air flow meter 7, a throttle angle sensor 9, a crank angle sensor 10, an engine coolant temperature sensor 11, an oxygen sensor 12 and an idle switch 13. The air flow meter 7 is disposed in the air induction system at a position upstream of the throttle valve 8 and monitors intake air flow rate to produce an air flow rate indicative signal Qa. Any type of air flow meter, such as Flap-type, hot wire-type, Karman's voltex-type and so forth can be employed. In the shown embodiment, a hot wire air flow meter is employed for monitoring the intake air flow rate.

It should be appreciated that the air flow meter can be replaced with a pressure sensor for monitoring vacuum pressure in the induction passage.

The throttle angle sensor 9 is associated with the throttle valve 8 for monitoring angular position of the throttle valve and produces a throttle angular position indicative signal TVO.

The crank angle sensor 10 can be associated with a crankshaft for monitoring angular position thereof. In the alternative, the crank angle sensor 10 can be associated with a distributor of a spark ignition system. The crank angle sensor 10 produces a crank reference signal $\theta_{ref}$ at every predetermined angular position of the crank shaft, e.g. 70° before the top-dead-center (BTDC) of respective engine cylinder, and crank position signal $\theta_{pos}$ at every given angular, e.g. 1° displacement of the crank shaft. The crank reference signal $\theta_{ref}$ and the crank position signal $\theta_{pos}$ have frequency proportional to the engine revolution speed. Therefore, these signals can be taken as an engine speed N representative data. For example, the interval between the occurrence of the crank reference signals is measured and the engine speed data N is derived based on the measured interval.

The engine coolant temperature sensor 11 monitors an engine-coolant temperature to produce an engine coolant temperature indicative signal Tw. The oxygen sensor 12 monitors an oxygen concentration in the exhaust gas to produce an oxygen concentration indicative signal Vs which represents rich and lean of the air/fuel mixture combustioned in the combustion chamber. In general, the oxygen sensor 12 varies the oxygen concentration indicative signal value between HIGH level and LOW level across a predetermined reference level corresponding to a stoichiometric value. The idle switch 13 turns ON in response to the engine idling condition to output HIGH level engine idling condition indicative signal. The idle switch 13 is generally associated with the throttle valve 8 for detecting fully closed position or an open angle smaller than a predetermined angle of the throttle valve to detect the engine idling condition.

Figure 2:
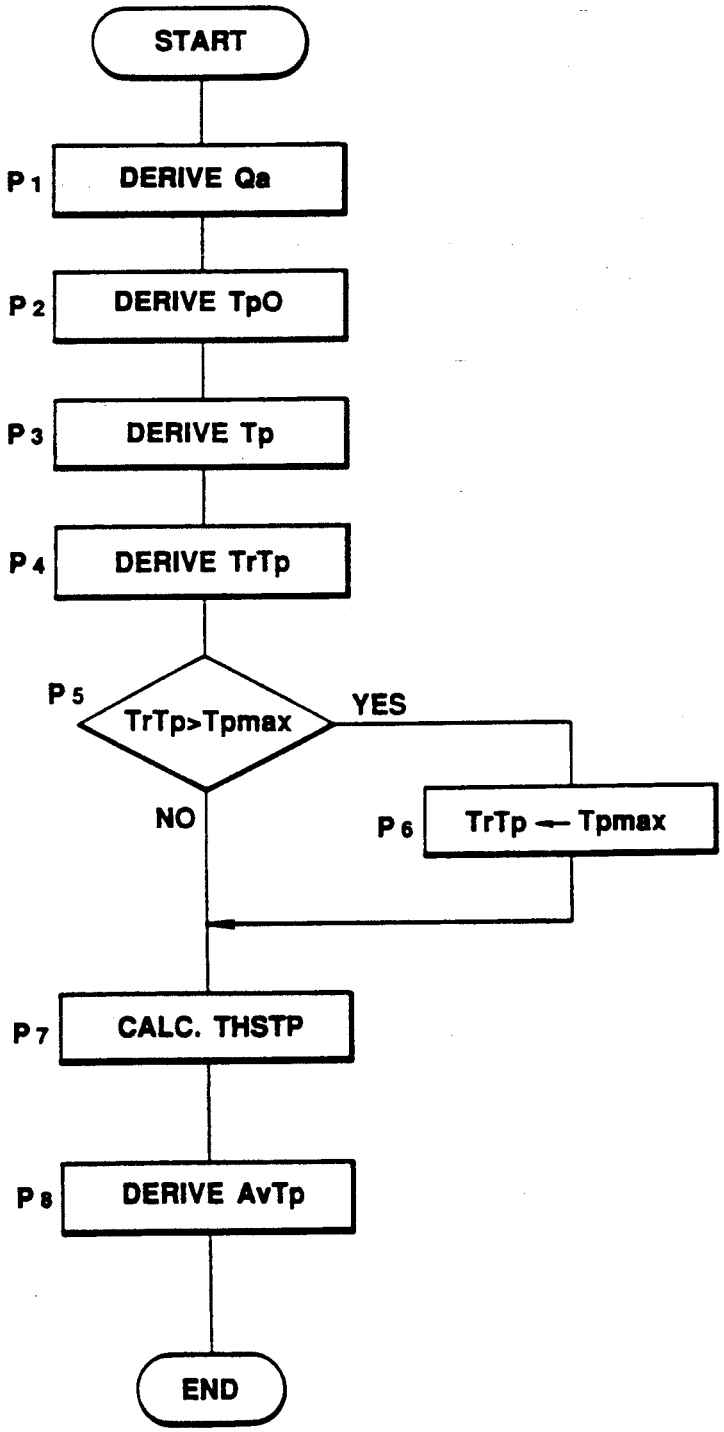
FIG. 2 is a flowchart showing process for deriving a smoothed fuel injection amount with a primary lag factor on the basis of a smoothed intake air flow rate.

With the construction set forth above, the control unit 20 performs control operation for controlling fuel injection amount to be injected through the fuel injection valves 4. In the shown embodiment, the fuel injection control system is constructed as so-called "sequential injection system" for performing fuel injection via each fuel injection valve at a timing determined with respect to valve open timing of intake valve of associated engine cylinder independently of other fuel injection valves. FIG. 2 shows a process of deriving a smoothed fuel injection amount AvTp. Immediately after starting execution, an intake air flow rate indicative data Qa is derived on the basis of the intake air flow rate indicative signal from the air flow meter 7 at a step P1. At the step P1, an engine speed data N is also derived on the basis of the crank reference signal $\theta_{ref}$. At a step P2, a basic fuel injection amount $Tp_0$ is derived by the following equation:

$$Tp_0 = K \times Qa/N \quad (1)$$

The basic fuel injection amount $Tp_0$ is derived on the basis of the intake air flow rate indicative data Qa which contains pulsating error component caused due to pulsatile air flow in the induction system 3. Then, at a step P3, a running average of the basic fuel injection amount $Tp_0$ is calculated to obtain a smoothed basic fuel injection amount Tp. By taking running average, an error component due to pulsatile flow of the intake air can be removed from the basic fuel injection amount. Thereafter, the smoothed basic fuel injection amount Tp is modified by an air/fuel ratio compensating correction coefficient $K_{flat}$ according to the following equation in order to derive a air/fuel ratio compensated fuel injection amount TrTp, at a step P4:

$$TrTp = Tp \times K_{flat} \quad (2)$$

Here, the air/fuel ratio compensating correction coefficient $K_{flat}$ is a correction coefficient derived on the basis of the engine speed N and α-N flow rate $Q_{ho}$ which is derived on the basis of the throttle valve angular position TVO and the engine speed N through a known process. In practical operation, the air/fuel ratio compensating correction coefficient $K_{flat}$ is derived by looking up a two-dimentional map and interpolation with respect to the map values.

The air/fuel ratio compensated fuel injection amount TrTp is compared with a predetermined maximum fuel injection amount $Tp_{max}$ at a step P5. When the air/fuel ratio compensated fuel injection amount TrTp is greater than the maximum fuel injection amount $Tp_{max}$ as checked at the step P5, the TrTp value is modified to the value corresponding to the maximum fuel injection amount $Tp_{max}$ at a step P6. On the other hand, when the air/fuel ratio compensated fuel injection amount TrTp is smaller than or equal to the maximum fuel injection amount $Tp_{max}$, process jumps the step P6.

At a step P7, an engine acceleration and deceleration state correction value THSTP is derived. Basically, the engine acceleration and deceleration state dependent correction value THSTP is determined by table look-up and interpolation in terms of the α-N flow rate $Q_{ho}$. Namely, the engine acceleration and deceleration state dependent correction value THSTP compensate lag time in fuel injection amount with respect to variation of the intake air flow rate. In the practical process, derivation of the engine acceleration and deceleration state dependent value TTHSTP is derived every 10 msec. in terms of the α-N flow rate $Q_{ho}$. Then, variation magnitude of the engine acceleration and deceleration state dependent value TTHSTP is compared with a predetermined threshold value within 10 msec. If the variation magnitude is smaller than the threshold value, the engine acceleration and deceleration state dependent correction value THSTP is set at zero (0). On the other hand, when the variation magnitude is greater than or equal to the threshold level, the engine acceleration and deceleration state dependent correction value THSTP is derived by multiplying the variation magnitude with a predetermined correction rate. In this case, when the engine is in accelerating state, the value THSTP becomes positive value. On the other hand, when the engine is in decelerating state, the value THSTP becomes negative value. Thereafter, the smoothed fuel injection amount AvTp corresponding to the smoothed intake air flow rate is derived according to the following equation, at a step P8:

$$AvTp = TrTp \times F_{LOAD} + AvTp_{-1} \times (1 - F_{LOAD}) + THSTP \quad (3)$$

where $F_{LOAD}$ is an averaging coefficient for deriving running average. Practically, the averaging coefficient $F_{LOAD}$ during the engine deceleration state can be derived by the following equation:

$$F_{LOAD} = TF_{LOAD} + K2D \quad (4)$$

where $TF_{LOAD}$ is a intake volume dependent function derived on the basis of intake air flow area AA and a unit time exhaust volume NVM (displacement × engine speed) by looking up a map.

In the process of derivation of the smoothed fuel injection amount AvTp according to the equation (3), the first and second terms serves for removing error component due to pulsatile air flow by primary lag factor digital filter operation by deriving running average utilizing averaging coefficient $F_{LOAD}$ and the air/f-uel ratio compensated fuel injection amount TrTp. On the other hand, the third term in the equation (3) serves for improving response characteristics to engine acceleration demand and deceleration demand by adding the engine acceleration and deceleration state dependent correction value THSTP in advance of actually varying the intake air flow rate indicative data.

Figure 3:
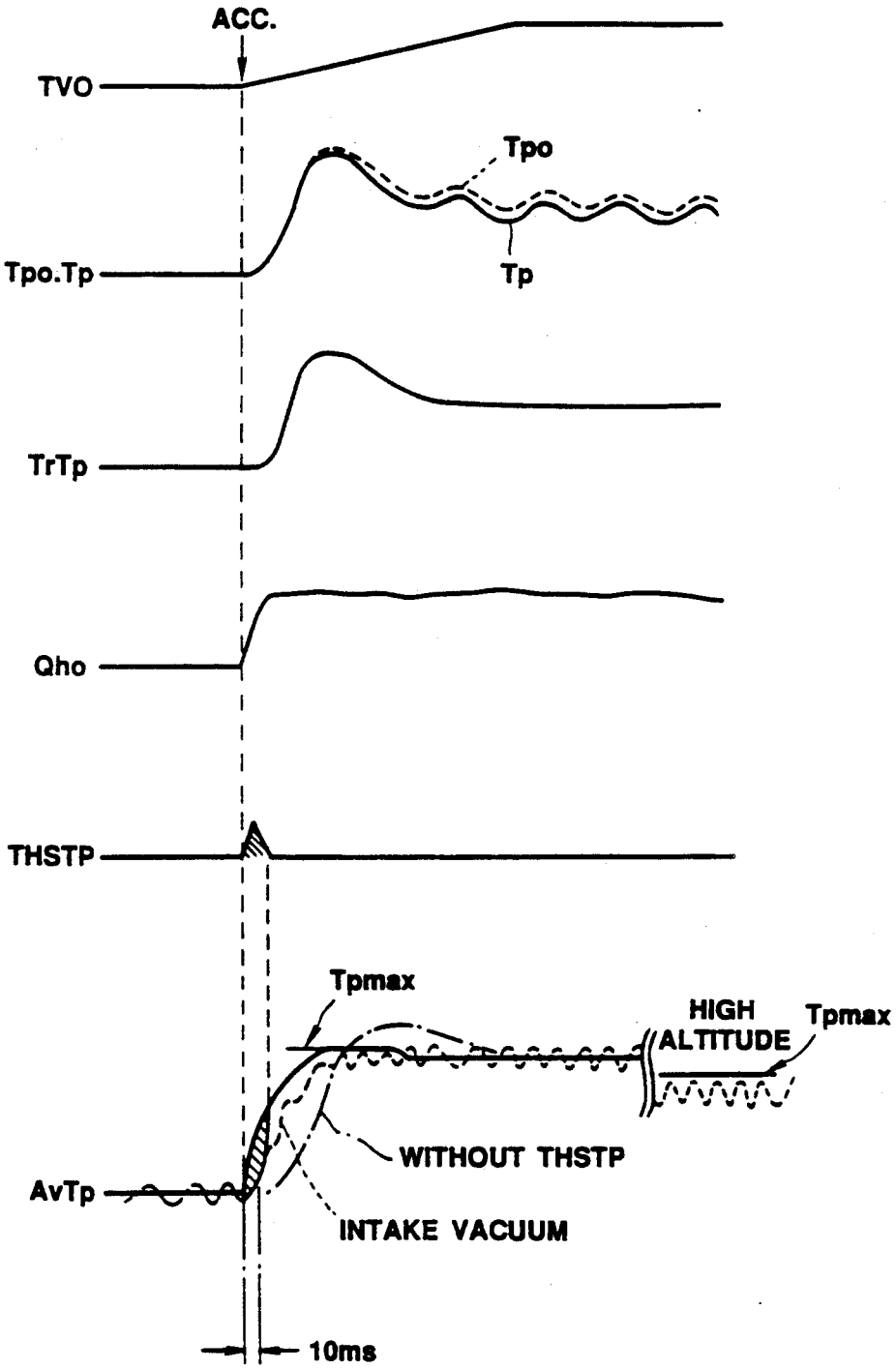
FIG. 3 is a timing chart showing variation of a throttle valve angular position TVO, a basic fuel injection amount $Tp_0$, a smoothed basic fuel injection amount Tp, a pulsatile component removed basic fuel injection amount TrTp, an arithmetically derived intake air flow rate $Q_{ho}$, a modified fuel injection pulse width THSTP and the smoothed fuel injection amount AvTp.

The effect of introducing of the engine acceleration and deceleration state dependent correction value THSTP will be appreciated from FIG. 3. Namely, as shown in FIG. 3, when engine acceleration is demanded at a certain timing as indicated, variation of the basic fuel injection amount $Tp_0$ and the modified fuel injection amount Tp occur with a delay time to occurrence of the acceleration demand. By correcting the modified fuel injection amount Tp for stabilizing variation of air/fuel ratio, the air/fuel ratio compensated fuel injection amount TrTp varies as shown. On the other hand, $\alpha$-N flow rate $Q_{ho}$ varies in stepwise fashion according to variation of the throttle valve angular displacement. As clear from FIG. 3, by adding the acceleration and deceleration dependent correction value THSTP, the primary lag factor which otherwise included in the smoothed fuel injection amount AvTp as shown by phantom line, can be successfully compensated as illustrated by the slid line. On the other hand, when the intake vacuum is taken as a parameter representative of the engine load, and the fuel injection amount is derived utilizing the intake vacuum, the fuel injection amount becomes approximately correspond to the air flow rate at the fuel injection valve. However, even by employing the intake vacuum as the engine load representative parameter, the response characteristics is still not satisfactory. Therefore, by employing the acceleration and deceleration dependent correction value, substantially high response to variation of the throttle valve angular position can be obtained.

As seen from FIG. 3, at low altitude area, the maximum fuel injection value $Tp_{max}$ corresponds to approximately center value of the pulsating intake vacuum dependent fuel injection amount. On the other hand, at high altitude area, the maximum fuel injection value $Tp_{max}$ becomes greater value than the intake vacuum dependent fuel injection amount.

Figure 4:
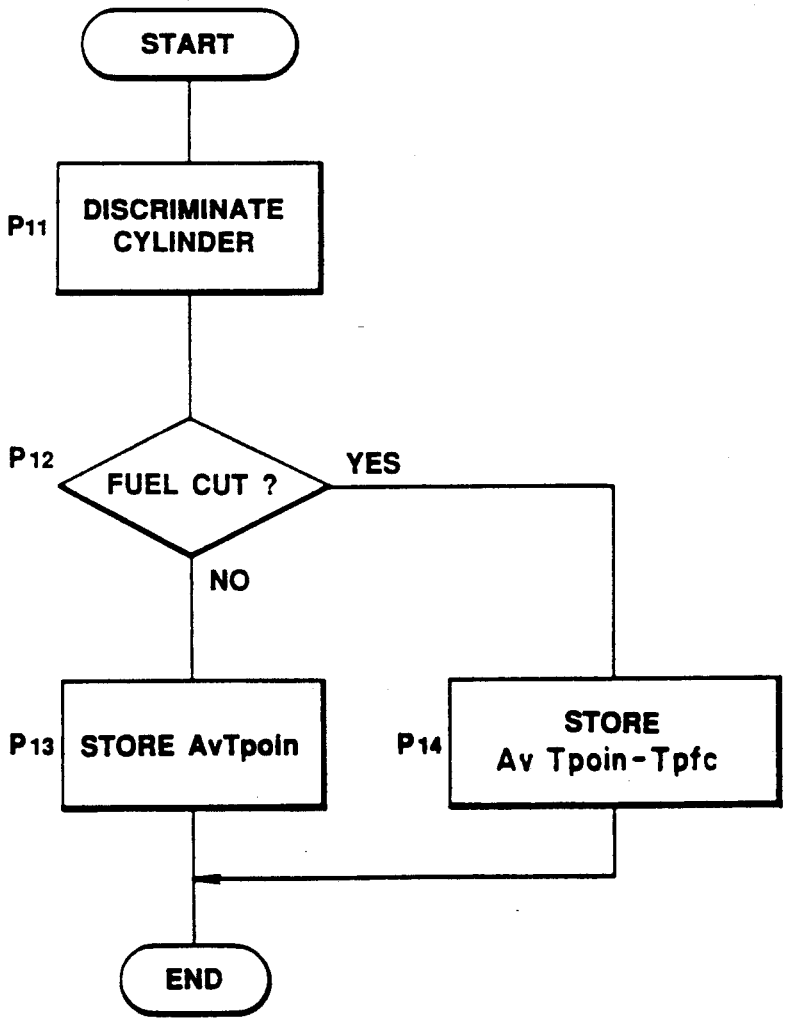
FIG. 4 is a flowchart showing a routine for setting a set value for deriving a fuel amount for asynchronous injection.

FIG. 4 shows a routine for controlling fuel injection amount. In the shown routine, fuel injection amount for asynchronous injection for acceleration enrichment after fuel cut-off operation can also be performed.

Immediately after starting execution, a cylinder for which fuel injection is currently performed is discriminated at a step P11. In practice, discrimination of the cylinder is performed with respect to the crankshaft angular position and known schedule of intake valve open timing for respective engine cylinders. Then, at a step P12, the fuel supply condition is checked whether the current status of the engine is in fuel cut-off state or not. When the engine operating state is not the cut-off state, then the instantaneous smoothed fuel injection amount AvTp used for the current fuel injection is set as an old fuel injection amount data which serves as the aforementioned set value AvTpoin of the smoothed fuel injection amount data in the immediately preceding fuel injection cycle at a step P13. When engine acceleration demand occurs in the fuel supply state of the engine, since the smoothed fuel injection amount AvTp is per se derived with taking the fuel amount for wetting the periphery of the induction system, fuel injection amount to be actually forming air/fuel mixture will become precisely corresponding to the demand.

Figure 5:
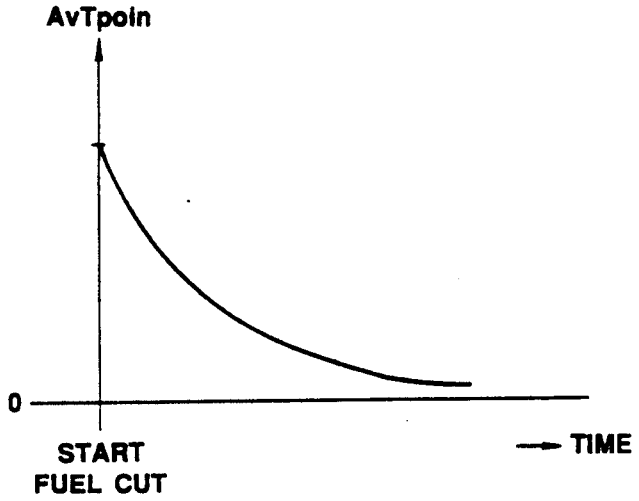
FIG. 5 is a chart showing variation of the set value according to length of a period to maintain fuel cut-off state.

On the other hand, when the fuel cut-off condition is detected as checked at a step P12, the set value AvTpoin is modified according to a period time to maintain fuel cut-off state. In the practical operation, the set value AvTpoin is cyclically decreased according to increasing of the period according to the characteristics shown in FIG. 5 In order to implement this, a predetermined value $T_{PFC}$ is substracted from the set value AvTpoin. The value $T_{PFC}$ may be set to vary according to length of the period to maintain fuel cut-off state for achieving the characteristics of FIG. 5.

It should be appreciated that though the shown embodiment decreases the set value AvTpoin in stepwise fashion, it may be possible to decrease the set value to zero in response to initiation of fuel cut-off. However, when fuel cut-off is terminated in substantially short period, relatively large amount of the fuel is still left on the periphery of the induction system. Therefore, it is preferred to introduce fuel cut-off period dependent factor for modifying the set value AvTpoin.

As is well known, in the actual fuel injection control, fuel injection pulse width is determined on the basis of the basic fuel injection amount and various correction factors. In the shown embodiment, the smoothed fuel injection amount AvTp is taken as the fuel injection amount for deriving the fuel injection pulse width. Correction for the basic fuel injection amount for deriving the fuel injection pulse width is per se well known technologies. For example, the engine coolant temperature Tw dependent correction coefficient, $\lambda$ control correction coefficient, and so forth are used as the correction factors for correcting the basic fuel injection amount. Furthermore, a correction coefficient derived by learning process in the modern fuel injection control may also be introduced as one of the correction factor. In addition, a correction value for compensating fuel amount for wetting the periphery of the induction system may also be used for correcting the basic fuel injection amount and deriving the fuel injection pulse width.

Figure 6:
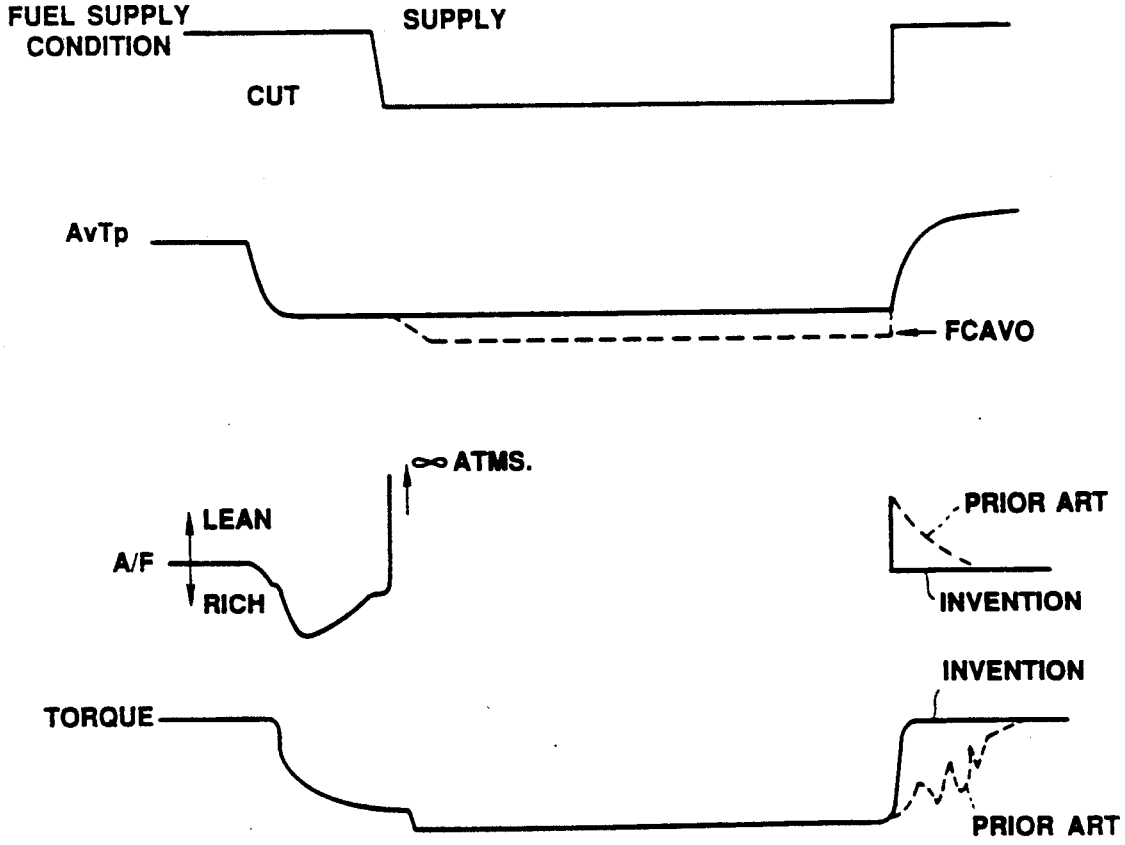
FIG. 6 is a timing chart showing variation of fuel supply condition, TvTp, air/fuel ratio (A/F) and an engine output torque.

As shown in FIG. 6, during fuel cut-off state, the fuel injection pulse width is decreased depending upon the elapsed time and finally becomes zero. Then, only intake air is introduced into the combustion chamber. Therefore, air/fuel ratio becomes infinite value. During this period, the engine output torque is lowered or becomes negative to cause coasting of the vehicle.

In response to depression of accelerator pedal for a certain magnitude, fuel cut-off operation is terminated. Then, the engine enters into acceleration transition period. At the initial stage of fuel resumption, asynchronous fuel injection is performed for quicker response of engine acceleration. For asynchronous injection, fuel injection amount is derived by subtracting the set value AvTpoin from a smoothed fuel injection amount AvTp derived with respect to the instantaneous engine driving parameters. Because the set value AvTpoin is decreased according to the elapsed time of maintaining of fuel cut-off, the decreasing magnitude of the set value AvTpoin substantially correspond to the decreasing amount of the fuel left on the periphery of the induction system. Therefore, in the asynchronous injection, fuel amount for wetting the fuel injection amount can be successfully compensated.

Therefore, according to the present invention, satisfactorily high response in engine transition state can be obtained with stability of air/fuel ratio control.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A fuel supply control system for an internal combustion engine, comprising:

an induction system for introducing a controlled flow rate of intake air and forming an air/fuel mixture to be introduced into an engine combustion chamber;

first sensor for monitoring intake air flow rate flowing through said induction system to produce an intake air flow rate indicative first signal;

second detector for monitoring a predetermined engine driving condition satisfying a fuel cut-off condition to produce a fuel cut-off condition indicative second signal;

first means for controlling fuel supply amount for supplying a controlled amount of fuel into said induction system at a controlled timing determined in relation to an engine revolution cycle, said first means being responsive to said second signal to perform fuel cut-off operation; and said first means being responsive to termination of said second signal, for temporarily performing fuel supply irrespective of engine revolution cycle; and second means for deriving a fuel supply amount for said temporary fuel supply in response to termination of fuel cut-off, said second means deriving said fuel supply amount for said temporary fuel supply with containing a component compensating a fuel amount required for wetting the periphery of said induction system, wherein said second means is responsive to initiation of said fuel cut-off operation for latching an instantaneous fuel supply amount upon initiation of fuel cut-off, and subtracting the latched value from an instantaneous fuel supply amount derived upon termination of fuel cut-off for deriving said fuel supply amount for temporary fuel supply, and said second means modifies said fuel supply amount by said compensating component for wetting the periphery of said induction system.

2. A fuel supply control system as set forth in claim 1, wherein said second means modifies to decrease the latched value according to elapsed time in performing fuel cut-off for including said compensating component in the fuel supply amount for temporary fuel supply.

3. A fuel injection control system for an internal combustion engine, comprising.

an induction system for introducing a controlled flow rate of intake air and forming an air/fuel mixture to be introduced into an engine combustion chamber;

first sensor for monitoring intake air flow rate flowing through said induction system to produce an intake air flow rate indicative first signal;

second detector for monitoring a predetermined engine driving condition satisfying a fuel cut-off condition to produce a fuel cut-off condition indicative second signal;

first means for controlling fuel injection amount for supplying a controlled amount of fuel into said induction system at a controlled timing determined in relation to an engine revolution cycle, said first means being responsive to said second signal to perform fuel cut-off operation, and said first means being responsive to termination of said second signal, for temporarily performing fuel injection irrespective of engine revolution cycle; and second means for deriving a fuel injection amount for said temporary fuel injection in response to termination of fuel cut-off, said second means deriving said fuel injection amount for said temporary fuel injection with containing a component compensating a fuel amount required for wetting the periphery of said induction system, wherein said second means is responsive to initiation of said fuel cut-off operation for latching an instantaneous fuel injection amount upon initiation of fuel cut-off, and subtracting the latched value from an instantaneous fuel injection amount derived upon termination of fuel cut-off for deriving said fuel injection amount for temporary fuel injection, and said second means modifies said fuel injection amount by said compensating component for wetting the periphery of said induction system.

4. A fuel injection control system as set forth in claim 3, wherein said second means modifies to decrease the latched value according to elapsed time in performing fuel cut-off for including said compensating component in the fuel injection amount for temporary fuel injection.

5. A fuel injection control system as set forth in claim 4, which further comprises a third sensor for monitoring an engine revolution to produce an engine speed indicative third signal, and said first means derives a basic fuel injection amount on the basis of said first signal and said third signal and modifies said basic fuel injection amount by introducing a primary lag factor.

* * * * *